US007073258B2

(12) United States Patent
Tessien et al.

(10) Patent No.: US 7,073,258 B2
(45) Date of Patent: Jul. 11, 2006

(54) METHOD OF CONSTRUCTING A PORT ASSEMBLY IN A SPHERICAL CAVITATION CHAMBER

(75) Inventors: Ross Alan Tessien, Nevada City, CA (US); Dario Felipe Gaitan, Nevada City, CA (US); Daniel A. Phillips, Grass Valley, CA (US)

(73) Assignee: Impulse Devices, Inc., Grass Valley, CA (US)

( * ) Notice: Subject to any disclaimer, the term of this patent is extended or adjusted under 35 U.S.C. 154(b) by 145 days.

(21) Appl. No.: 10/935,364

(22) Filed: Sep. 7, 2004

(65) Prior Publication Data

US 2006/0042086 A1 Mar. 2, 2006

Related U.S. Application Data

(63) Continuation of application No. 10/926,602, filed on Aug. 25, 2004.

(51) Int. Cl.
*B21D 52/56* (2006.01)
*B23P 22/02* (2006.01)
*B06B 1/00* (2006.01)

(52) U.S. Cl. ..... 29/890.09; 29/451; 422/128

(58) Field of Classification Search ..... 29/890.09, 29/451, 453, 464, 469, 525.01, 428, 592, 29/594; 422/128, 127; 137/803
See application file for complete search history.

(56) References Cited

U.S. PATENT DOCUMENTS 4,333,796 A * 6/1982 Flynn ..... 376/100
4,448,743 A 5/1984 Bass
4,563,341 A 1/1986 Flynn
5,344,532 A * 9/1994 Joseph ..... 204/157.15
5,659,173 A * 8/1997 Putterman et al. ..... 250/361 C
5,858,104 A 1/1999 Clark
6,361,747 B1 3/2002 Dion et al.

OTHER PUBLICATIONS

US—PCT/US00/31341, filed May 31, 2001, Tessien.
Blake et al, Acoustic Cavitation:The Fluid Dynamics of Non-Spherical Bubbles, Phil. Trans. R. Soc. Lond. A, 1999, pp. 251-267, vol. 357, Publisher: The Royal Society, Published in: Great Britain.
Dan et al, Ambient Pressure Effect on Single-Bubble Sonoluminescence, Physical Review Letters, Aug. 30, 1999, pp. 1870-1873, vol. 83, No. 9, Published in: US.

(Continued)

*Primary Examiner*—John C. Hong
(74) *Attorney, Agent, or Firm*—Patent Law Office of David G. Beck

(57) ABSTRACT

A method of constructing a port assembly for use with a single piece cavitation chamber, typically a spherical chamber, is provided. The port assembly includes a cone-shaped port, a cone-shaped mounting ring and a central member mounted within the mounting ring. The mounting ring is located within the chamber prior to the final assembly of the chamber itself, i.e., at a time in which the chamber is comprised of multiple pieces. After the final assembly of the chamber is complete, a central member such as a window, plug, gas feed-thru, liquid feed-thru, mechanical feed-thru or sensor assembly is placed within the chamber. The mounting ring is then pulled into place within the cone-shaped port, followed by the central member. To expedite assembly, specialized tools can be used to pull the mounting ring and the central member into place.

28 Claims, 11 Drawing Sheets

OTHER PUBLICATIONS

Moss et al., Computed Optical Emissions from a Sonoluminescing Bubble, Physical Review E, Mar. 1999, pp. 2986-2992, vol. 59, No. 3, Published in: US.

Gaitan et al, Experimental Observations of Bubble Response and Light Intensity Near the Threshold for Single Bubble Sonoluminescence, Physical Review E, May 1999, pp. 5495-5502, vol. 59, No. 5, Published in: US.

Barber et al, Sensitivity of Sonoluminescence to Experimental Parameters, Physical Review Letters, Feb. 28, 1994, pp. 1380-1382, vol. 72, No. 9.

Putterman, Sonoluminescence:Sound Into Light, Scientific American, Feb. 1995, pp. 46-51.

Gaitan et al, Sonoluminescence and Bubble Dynamics for a Single, Stable, Cavitation Bubble, J. Acoust. Soc. Am., Jun. 1992, pp. 3166-3183, vol. 91, No. 6.

CRUM, Sonoluminescence, Physics Today, Sep. 1994, pp. 22-29.

Bollinger, Ultra Cavitation, http://wiretap.area.com/Gopher/Library/Article/Sci/cavitate.ult, Sep. 17, 2001, pp. 1-26.

* cited by examiner

METHOD OF CONSTRUCTING A PORT ASSEMBLY IN A SPHERICAL CAVITATION CHAMBER

CROSS-REFERENCE TO RELATED APPLICATIONS

This application is a continuation of U.S. patent application Ser. No. 10/926,602, filed Aug. 25, 2004.

FIELD OF THE INVENTION

The present invention relates generally to sonoluminescence and, more particularly, to a method of constructing a port assembly in a sonoluminescence cavitation chamber.

BACKGROUND OF THE INVENTION

Sonoluminescence is a well-known phenomena discovered in the 1930's in which light is generated when a liquid is cavitated. Although a variety of techniques for cavitating the liquid are known (e.g., spark discharge, laser pulse, flowing the liquid through a Venturi tube), one of the most common techniques is through the application of high intensity sound waves.

In essence, the cavitation process consists of three stages; bubble formation, growth and subsequent collapse. The bubble or bubbles cavitated during this process absorb the applied energy, for example sound energy, and then release the energy in the form of light emission during an extremely brief period of time. The intensity of the generated light depends on a variety of factors including the physical properties of the liquid (e.g., density, surface tension, vapor pressure, chemical structure, temperature, hydrostatic pressure, etc.) and the applied energy (e.g., sound wave amplitude, sound wave frequency, etc.).

Although it is generally recognized that during the collapse of a cavitating bubble extremely high temperature plasmas are developed, leading to the observed sonoluminescence effect, many aspects of the phenomena have not yet been characterized. As such, the phenomena is at the heart of a considerable amount of research as scientists attempt to not only completely characterize the phenomena (e.g., effects of pressure on the cavitating medium), but also its many applications (e.g., sonochemistry, chemical detoxification, ultrasonic cleaning, etc.).

In order to study the sonoluminescence phenomena, it is clearly important to be able to closely monitor the cavitating bubbles as well as the intensity, frequency and timing of the resultant sonoluminescence. Additionally, some research may require probing the cavitating liquid. Lastly, many cavitation experiments utilize external means of introducing the bubbles into the liquid, for example bubble tubes or hot wires, thus requiring further means of entering the cavitating medium.

Although access to the liquid within a cavitation chamber is typically required before, during and after a cavitation experiment, typically this does not present a problem as most cavitation research is performed at relatively low pressure. As such, glass or other transparent material is generally used for the chamber, thus providing an easy means of monitoring on-going experiments. Additionally, such experiments often use standard beakers or flasks as the cavitation chamber, allowing convenient access to the cavitation medium.

U.S. Pat. No. 4,333,796 discloses a cavitation chamber that is generally cylindrical although the inventors note that other shapes, such as spherical, can also be used. As disclosed, the chamber is comprised of a refractory metal such as tungsten, titanium, molybdenum, rhenium or some alloy thereof and the cavitation medium is a liquid metal such as lithium or an alloy thereof. Surrounding the cavitation chamber is a housing which is purportedly used as a neutron and tritium shield. Projecting through both the outer housing and the cavitation chamber walls are a number of acoustic horns. The specification only discloses that the horns, through the use of flanges, are secured to the chamber/housing walls in such a way as to provide a seal. Similarly, although the specification discloses the use of a tube to distribute H-isotopes into the host material during cavitation, the specification does not disclose how the tube is to be sealed as it passes through the chamber/housing walls. Similarly U.S. Pat. No. 4,563,341, a continuation-in-part of U.S. Pat. No. 4,333,796, does not disclose means for the inclusion of a port with the disclosed cylindrical chamber.

U.S. Pat. No. 5,659,173 discloses a sonoluminescence system that uses a transparent spherical flask. The spherical flask is not described in detail, although the specification discloses that flasks of Pyrex®, Kontes®, and glass were used with sizes ranging from 10 milliliters to 5 liters. As the disclosed flask is transparent, the PMT used to monitor the sonoluminescence was external to the chamber. The drivers as well as a microphone piezoelectric were epoxied to the exterior surface of the chamber. The use of a transparent chamber also allowed the use of an external light source, e.g., a laser, to determine bubble radius without requiring the inclusion of a window in the chamber walls.

U.S. Pat. No. 5,858,104 discloses a shock wave chamber partially filled with a liquid. The remaining portion of the chamber is filled with gas which can be pressurized by a connected pressure source. Acoustic transducers are used to position an object within the chamber. Another transducer delivers a compressional acoustic shock wave into the liquid. A flexible membrane separating the liquid from the gas reflects the compressional shock wave as a dilation wave focused on the location of the object about which a bubble is formed. The patent simply discloses that the transducers are mounted in the chamber walls without stating how the transducers are to be mounted. Similarly, there is no discussion of mounting ports (e.g., view ports) within the chamber walls.

U.S. Pat. No. 6,361,747 discloses an acoustic cavitation reactor in which the reactor chamber is comprised of a flexible tube. The liquid to be treated circulates through the tube. Electroacoustic transducers are radially distributed around the tube, apparently coupled to the flexible tube by being pressed against the exterior surface of the tube. The heads of the transducers have the same curvature as the tube, thus helping to couple the acoustic energy. A film of lubricant interposed between the transducer heads and the wall of the tube further aid the coupling of the acoustic energy to the tube.

Although not in the field of sonoluminescence, U.S. Pat. No. 4,448,743 discloses a confinement chamber for use with an ultra-high temperature steady-state plasma. The specification refers to the plasma as a plasmasphere but is unclear as to whether the confinement chamber is spherical or cylindrical in nature. The disclosed chamber includes multiple transparent ports, for example made of germanium or sodium chloride, but does not disclose how the ports are fabricated or installed within the chamber.

One approach to fabricating a high pressure spherical cavitation chamber is disclosed in co-pending patent application Ser. No. 10/925,070, filed Aug. 23, 2004, entitled Method of Fabricating a Spherical Cavitation Chamber. In order to provide optimum high pressure performance, in addition to being spherically shaped, the inside spherical surface has only a very minor fabrication seam. Such a chamber, however, provides a challenge as to port mounting, especially if the smooth inside surface and the high pressure aspects of the chamber are to be maintained.

Accordingly, what is needed is a means of including one or more ports in a high pressure spherical chamber. The present invention provides a method of constructing such a port assembly.

SUMMARY OF THE INVENTION

The present invention provides a method of constructing a port assembly in a single piece cavitation chamber, typically a spherical chamber. The method is comprised of the steps of boring a cone-shaped port in a cavitation chamber wall of one piece of the cavitation chamber, locating a mounting ring with a cone-shaped external surface corresponding to the cone-shaped port within the cavitation chamber prior to assembling the multiple pieces that comprise the cavitation chamber, assembling the multiple cavitation chamber pieces together to form the cavitation chamber, placing a cone-shaped member within the cavitation chamber, pulling the mounting ring into the cone-shaped port, and pulling the member into the mounting ring. The internal surface of the mounting ring has a cone-shape corresponding to the external surface of the member. The largest diameter of the member is smaller than the smallest diameter of the port, thus insuring that it can be placed within the cavitation chamber after chamber assembly. The member can be a window, plug, gas feed-thru, liquid feed-thru, mechanical feed-thru, sensor, sensor coupler, transducer coupler or plug. To expedite assembly, specialized tools can be used to pull the mounting ring and the member into place.

In one embodiment, the inner surface of the mounting ring and/or the inner surface of the member are shaped, preferably shaped to form a curved surface, and more preferably shaped to form a curved surface that matches the spherical curvature of the internal surface of the cavitation chamber.

In one embodiment, an external retaining ring is coupled to the mounting ring. Preferably a portion of an external surface of the mounting ring is recessed relative to the cavitation chamber external surface, thus insuring that the retaining ring is able to seal the mounting ring within the cavitation chamber wall. Alternately, a portion of a retaining ring surface adjacent to the mounting ring external chamber surface is recessed.

In one embodiment, an external retaining plate is coupled to the member. Preferably the external chamber surface of the mounting ring and/or the external chamber surface of the member are recessed relative to the cavitation chamber external surface, thus insuring that the retaining plate is able to seal the mounting ring within the cavitation chamber wall and the member within the mounting ring. Alternately, a portion of the surface of the retaining plate adjacent to the external chamber surfaces of the member and/or mounting ring is recessed.

In one embodiment, the surface of the external retaining ring adjacent to the external surface of the cavitation chamber is shaped, preferably shaped to form a curved surface, and more preferably shaped to form a curved surface that matches the spherical curvature of the external surface of the cavitation chamber.

In one embodiment a malleable material, preferably of a metal, and more preferably of brass, is interposed between the internal cone-shaped surface of the mounting ring and the external cone-shaped surface of the member. In one embodiment a malleable material, preferably of a metal, and more preferably of brass, is interposed between the cone-shaped port and the external cone-shaped surface of the mounting ring.

In one embodiment a sealant and/or adhesive is interposed between the internal cone-shaped surface of the mounting ring and the external cone-shaped surface of the member. In one embodiment a sealant and/or adhesive is interposed between the internal port surface and the external cone-shaped surface of the mounting ring.

In one embodiment one or more 0-rings are interposed between the internal port surface and the external cone-shaped surface of the mounting ring. In one embodiment one or more 0-rings are interposed between the internal cone-shaped surface of the mounting ring and the external cone-shaped surface of the member.

A further understanding of the nature and advantages of the present invention may be realized by reference to the remaining portions of the specification and the drawings.

DESCRIPTION OF THE SPECIFIC EMBODIMENTS

Figure 1:
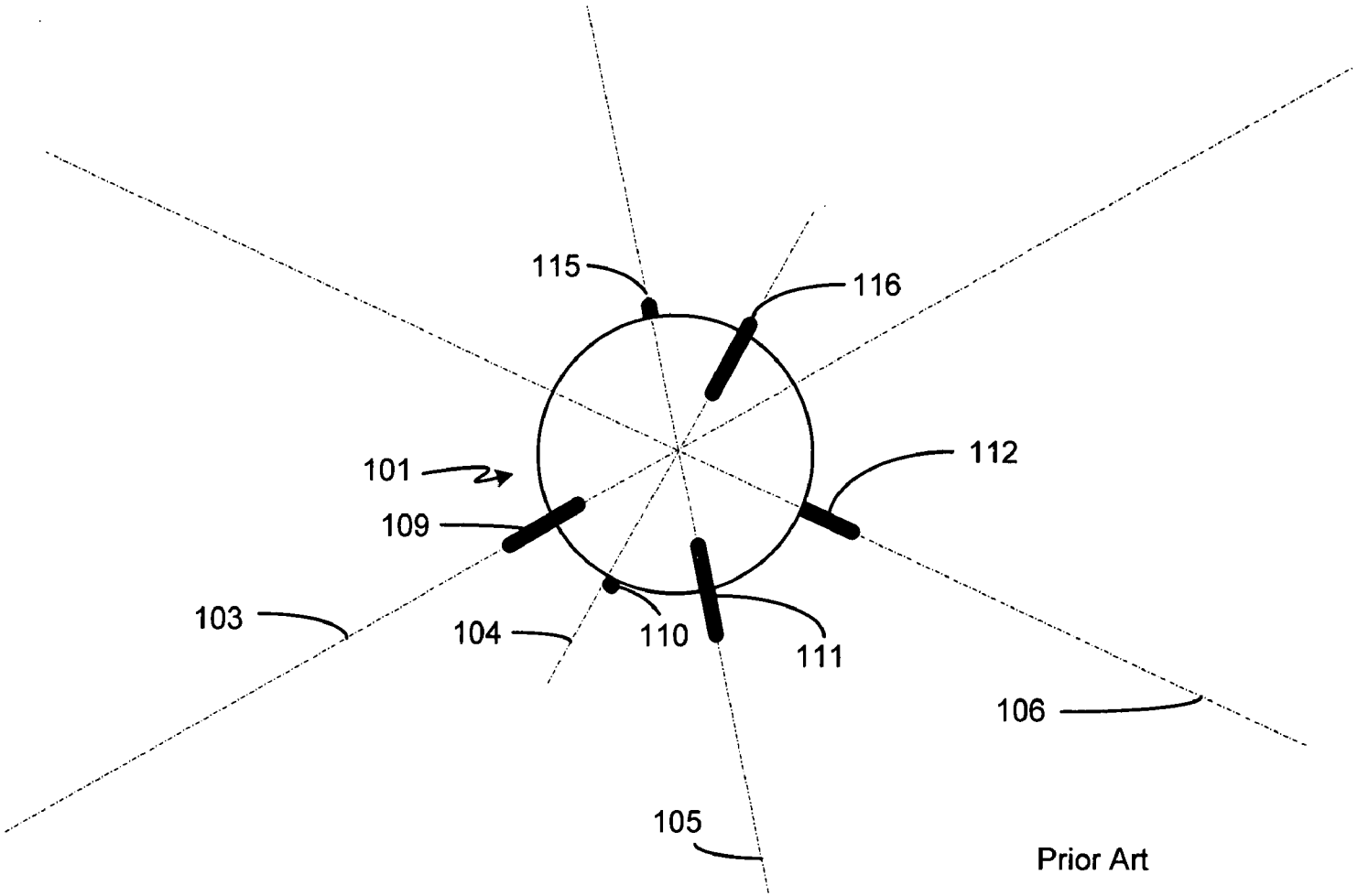
FIG. 1 is an illustration of a spherical sonoluminescence cavitation chamber without ports in accordance with the prior art.

FIG. 1 is an illustration of a spherical sonoluminescence cavitation chamber 101, hereafter referred to as simply a cavitation chamber, according to the prior art. Transducers 109–112 are mounted to the lower hemisphere of chamber 101 and transducers 115–116 are mounted to the upper hemisphere of chamber 101.

Figure 2:
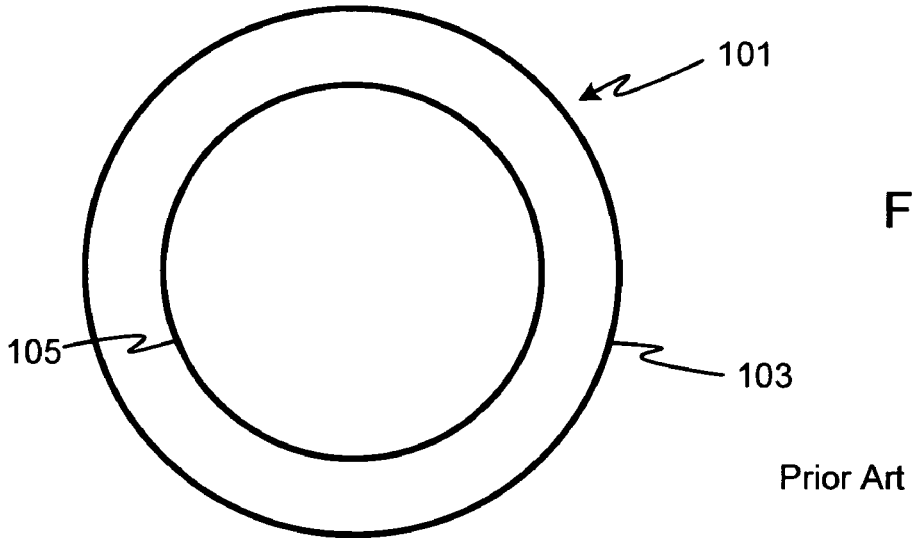
FIG. 2 is a cross-sectional view of the spherical cavitation chamber shown in FIG. 1.

FIG. 2 is a cross-sectional view of spherical cavitation chamber 101. Chamber 101 has an outer spherical surface 103 defining the outer diameter of the chamber, and an inner spherical surface 105 defining the inner diameter of the chamber.

Chamber 101 can be fabricated from any of a variety of materials, depending primarily on the desired operating temperature and pressure, as well as the fabrication techniques used to make the chamber. Typically the chamber is fabricated from a metal; either a pure metal or an alloy such as stainless steel.

With respect to the dimensions of the chamber, both inner and outer diameters, the selected sizes depend upon the intended use of the chamber. For example, smaller chambers are typically preferable for situations in which the applied energy (e.g., acoustic energy) is somewhat limited. Similarly, thick chamber walls are preferable if the chamber is to be operated at high static pressures. For example, the prior art discloses wall thicknesses of 0.25 inches, 0.5 inches, 0.75 inches, 1.5 inches, 2.375 inches, 3.5 inches and 4 inches, and outside diameters in the range of 2–10 inches.

It will be appreciated that the present invention is not limited to a particular outside chamber diameter, inside chamber diameter, chamber material, chamber shape, transducer type, transducer number, or transducer mounting location. Such information, as provided herein, is only meant to provide exemplary chamber configurations for which the present invention is applicable.

Figure 3:
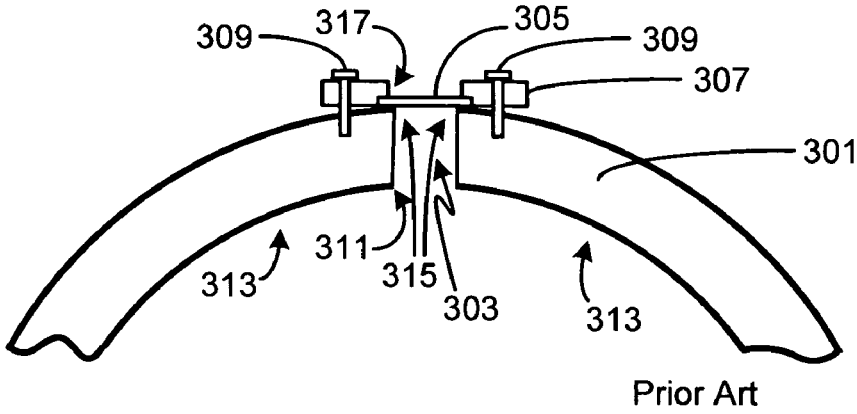
FIG. 3 is a cross-sectional view of a port assembly, including a window, in accordance with the prior art.

FIG. 3 is a cross-sectional view of a window and port assembly in accordance with the prior art. For ease of illustration, only a portion of wall 301 of a spherical chamber such as the one provided in FIG. 2 is shown in the following figures. A port 303 has been bored through wall 301. In the illustrated embodiment, port 303 is used as an observation port, thus requiring a window 305 to be placed over the port. Window 305 is attached using a standard window mounting flange 307, the flange being held to wall 301 with multiple bolts 309. Typically a window sealing member, not shown, is included in this configuration to insure a gas tight assembly.

The prior art means of providing a port, as well as the prior art means of attaching a window or other member to the port, suffers from several problems. First, the edge 311 of the port presents a significant discontinuity along surface 313 of wall 301, the discontinuity effecting the cavitation process. Second, for high pressure systems the window of this port assembly is prone to failure as there is minimal contact area between window 305 and wall 301 (i.e., area 315) and minimal contact area between window 305 and flange 307 (i.e., area 317). Third, it is difficult to achieve an adequate seal between the window (or similar port member) and wall 301.

Figure 4:
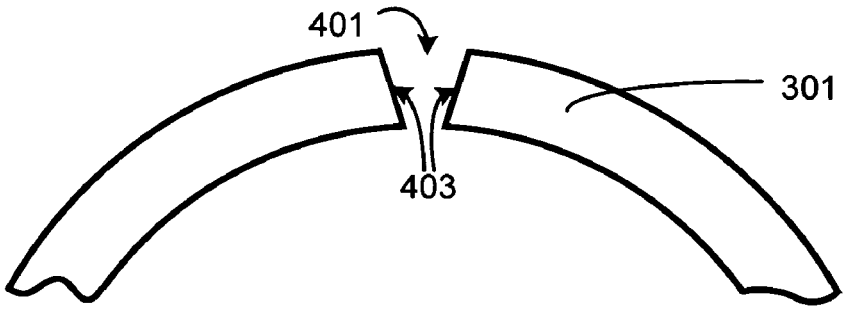
FIG. 4 is a cross-sectional view of a cone-shaped port.
Figure 5:
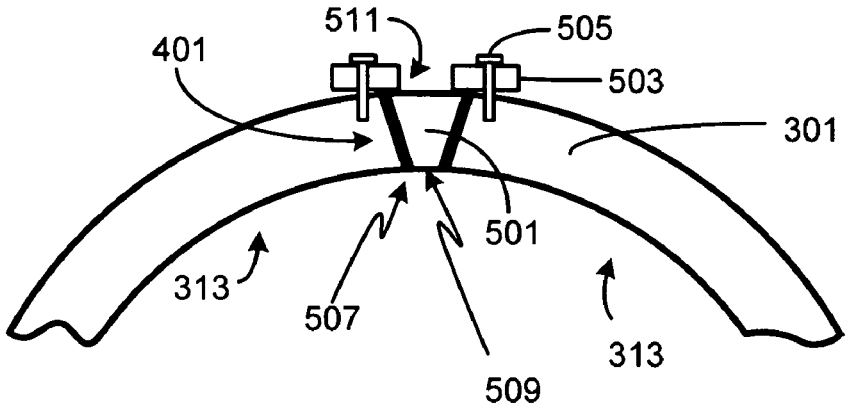
FIG. 5 is a cross-sectional view of a cone-shaped window or plug within the port of FIG. 4.

One approach to alleviating at least some of the issues of the prior art port assembly is illustrated in FIGS. 4 and 5. As shown, the port 401 bored into chamber wall 301 includes slanted surfaces 403, thus providing a cone-shaped port. A similarly shaped window (or plug) 501 fits within port 401, held in place with retaining ring 503. Retaining ring 503 is mounted to chamber wall 301 with a plurality of bolts 505.

One benefit of the assembly shown in FIG. 5 is that the window is much thicker, thus making it less prone to breakage or gas leaks. Additionally the discontinuity at region 507 is greatly reduced as the window can be made thick enough so that the interior surface 509 of window 501 is in line with interior chamber surface 313. If desired, window surface 509 can even be fabricated with the same curvature as the interior chamber surface, thus minimizing internal chamber variations.

Although the assembly shown in FIGS. 4 and 5 is an improvement over the prior art port assembly, especially when used with an evacuated chamber, when used with a high pressure system it still applies stress to the window (or port plug) in a relatively small region 511. This is because the shape of member 501 does not provide any sealing or holding mechanism. Unless a strong bonding material is provided at the interface between member 501 and port 401, only retaining ring 503 holds member 501 in place. Accordingly this places a great amount of stress in a very small area, thus leading to frequent window breakage when used at high pressure.

Figure 6:
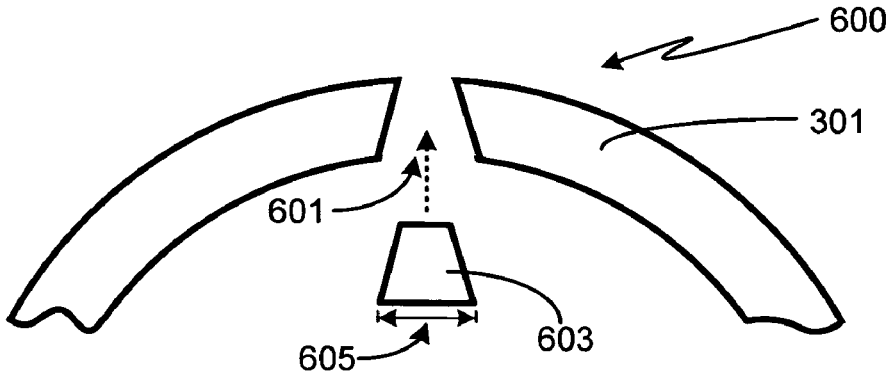
FIG. 6 is a cross-sectional view of a cone-shaped port in which the configuration of the port is reversed from the port shown in FIG. 4.

FIG. 6 illustrates an alternate embodiment of the invention useful with high internal pressure chambers. In this embodiment port 601 is again cone-shaped. Unlike the previous embodiment, however, the direction of port 601 is reversed so that the small diameter of the port is located on the outer surface of chamber wall 301. Assuming a window (or plug) 603, it will be appreciated that the pressure within the chamber would push member 603 outward, thus providing not only an improved seal, but more importantly a means of distributing the force over a much larger region than in the port assemblies shown in FIGS. 3 and 5. As a result, member 603 is less likely to crack or break during use.

Although the embodiment shown in FIG. 6 has an improved resistance to stress-induced breakage, the inventor has found this embodiment to be problematic as member 603 cannot be replaced once the cavitation chamber is fabricated. Thus either the chamber must be capable of being disassembled/reassembled or member 603 must be located within the chamber prior to completion. The former approach is unsatisfactory as it is difficult to achieve the desired high pressure levels with a chamber that can be easily disassembled/reassembled. The latter approach is unsatisfactory as most window materials cannot withstand the chamber fabrication steps (e.g., brazing temperature).

Figure 7:
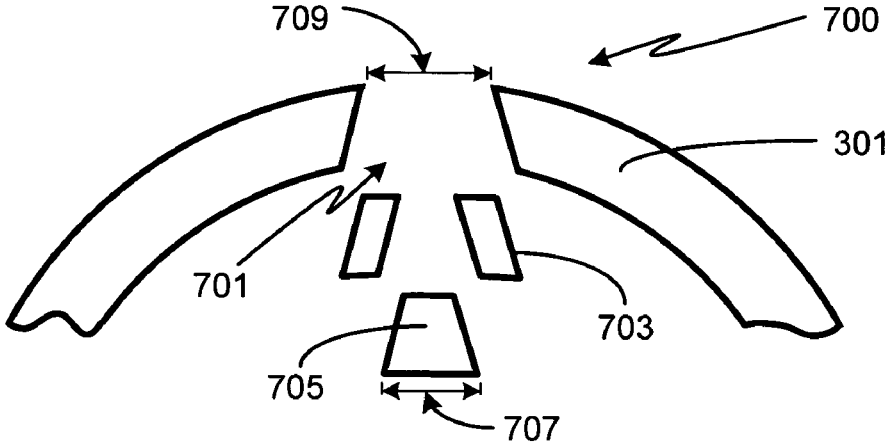
FIG. 7 is a cross-sectional view of a port assembly that includes a cone-shaped port, a cone-shaped mounting ring and a cone-shaped member.
Figure 8:
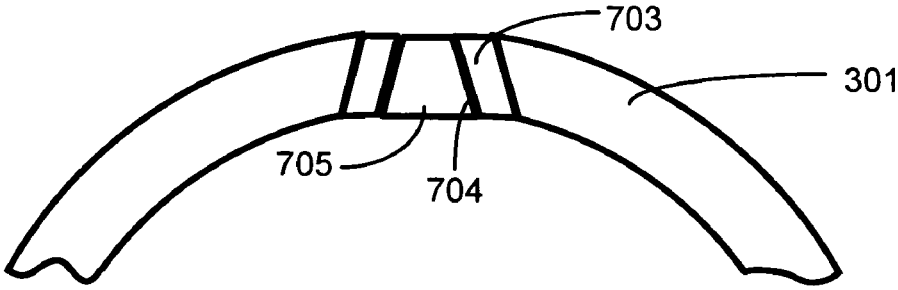
FIG. 8 is a cross-sectional view of the port assembly of FIG. 7 assembled.

FIGS. 7 and 8 illustrate a preferred port assembly 700 of the invention which overcomes the previously cited problem of member replacement after chamber completion. Although a cavitation chamber that only uses port assemblies such as the one illustrated in FIGS. 7 and 8 can be fabricated, the inventor has found that preferably a cavitation chamber includes only one such port assembly with the remaining port assemblies being of the type shown in FIG. 6. Assuming that the dimensions of the various port elements are selected according to the criteria provided herein, such a system allows member 603 to be replaced after chamber completion using the larger port of assembly 700.

As shown in the exploded view of FIG. 7, the primary elements of this embodiment include a cone-shaped port 701, a cone-shaped mounting ring 703 and a member 705. Member 705 can be a window, gas feed-thru, liquid feed-thru, sensor (e.g., thermocouple), sensor coupler, mechanical feed-thru (e.g., manipulating arm), transducer coupler, plug, or any other suitably shaped member.

The critical aspect of this embodiment is that the diameter 707 of member 705 must be smaller than the diameter 709 of port 701. As long as diameter 707 is smaller than diameter 709, member 705 can be replaced whenever desired without requiring the disassembly of the chamber. If port assembly 700 is to be used in conjunction with a port assembly 600 as previously described, the diameter 605 of member 603 must be smaller than the diameter 709 of port 701, thus allowing member 603 to be replaced through port 701 without disassembling the chamber.

As described in detail in co-pending application Ser. No. 10/925,070, filed Aug. 23, 2004, entitled Method of Fabricating a Spherical Cavitation Chamber, the disclosure of which is incorporated herein for any and all purposes, one method of fabricating a high pressure cavitation chamber is to first fabricate two spherical chamber halves and then join the two halves to form the desired cavitation chamber. The two chamber halves can be joined, for example, using a brazing operation in which the brazing material is in the form of a thin ring with inside and outside diameters of approximately the same size as those of the cavitation chamber.

In accordance with a preferred embodiment of the present invention, prior to joining the two chamber halves one or more cone-shaped ports 701 are bored into one, or both, chamber halves at the desired locations. It will be appreciated, however, that one or more ports 701 can be bored into the chamber after the two chamber halves are joined together. Before joining the chamber halves, a number of cone-shaped mounting rings 703 corresponding to the desired number of ports are placed between the two halves, and then the two halves are joined together. As the mounting ring or rings 703 must survive the joining process, e.g., brazing operation, preferably ring 703 is fabricated from the same material as the cavitation chamber (e.g., stainless steel). In an alternate preferred embodiment ring 703 can be fabricated from a different material, for example one with a higher melting point than the cavitation chamber.

After cavitation chamber 101 has been completed, member 705 (e.g., a window) is placed through port 701. Mounting ring 703 is then pulled into place within port 701 followed by member 705. If at some point during the life of the cavitation chamber it becomes necessary to replace member 705, the chamber pressure is released, the cavitation liquid is drained and then the member mounting procedure is simply reversed, the member is replaced and the process is repeated (i.e., member 705 pushed into the chamber, ring 703 pushed into the chamber, member 705 removed, replacement member 705 located within the chamber, ring 703 pulled into place, and new member 705 pulled into place).

In an alternate preferred embodiment, the cavitation chamber includes at least one port assembly 700 and one or more port assemblies 600. It will be appreciated that if additional port assemblies 600 are required after chamber completion, the additional port or ports 601 can be bored into the chamber after the chamber has been constructed. In this embodiment prior to assembling port assembly 700, each of the port assemblies 600 are assembled. To assemble each port assembly 600, the corresponding member 603 is inserted through port 701 and positioned within the desired port 601. After all of the port assemblies 600 have been completed, mounting ring 703 is pulled into place within port 701 followed by member 705. If it becomes necessary to replace a member 603, it can be replaced through port 701 after a standard port disassembly procedure.

The inventor has found that a variety of tools can be used to pull ring 703 and member 705 into place within port 701 and to position member 603 within port 601. Accordingly the invention is not limited to a specific assembly tool or tools. The following assembly tools are only meant to be illustrative of a few of the possible assembly methods and tools.

Figure 9:
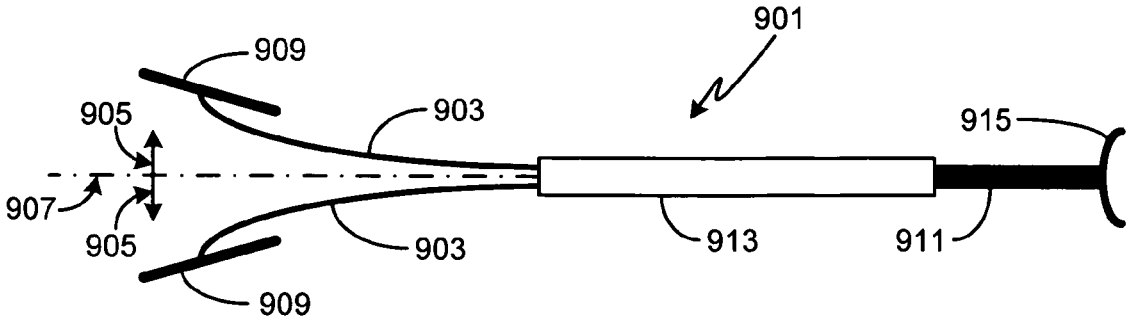
FIG. 9 is an illustration of a tool used to pull the mounting ring into place.
Figure 10:
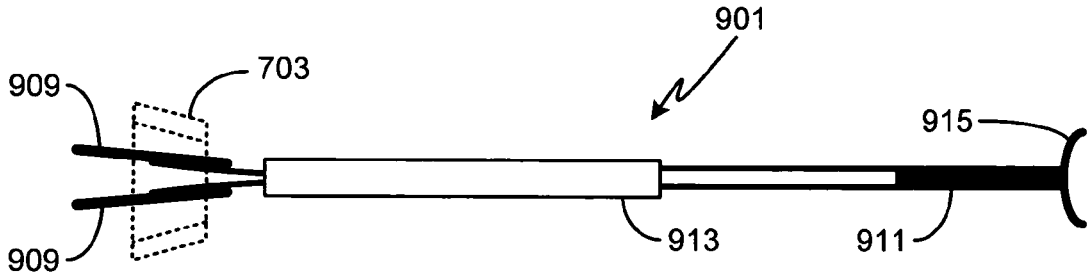
FIG. 10 is an illustration of the tool shown in FIG. 9 in which the ring holding members are compressed.
Figure 11:
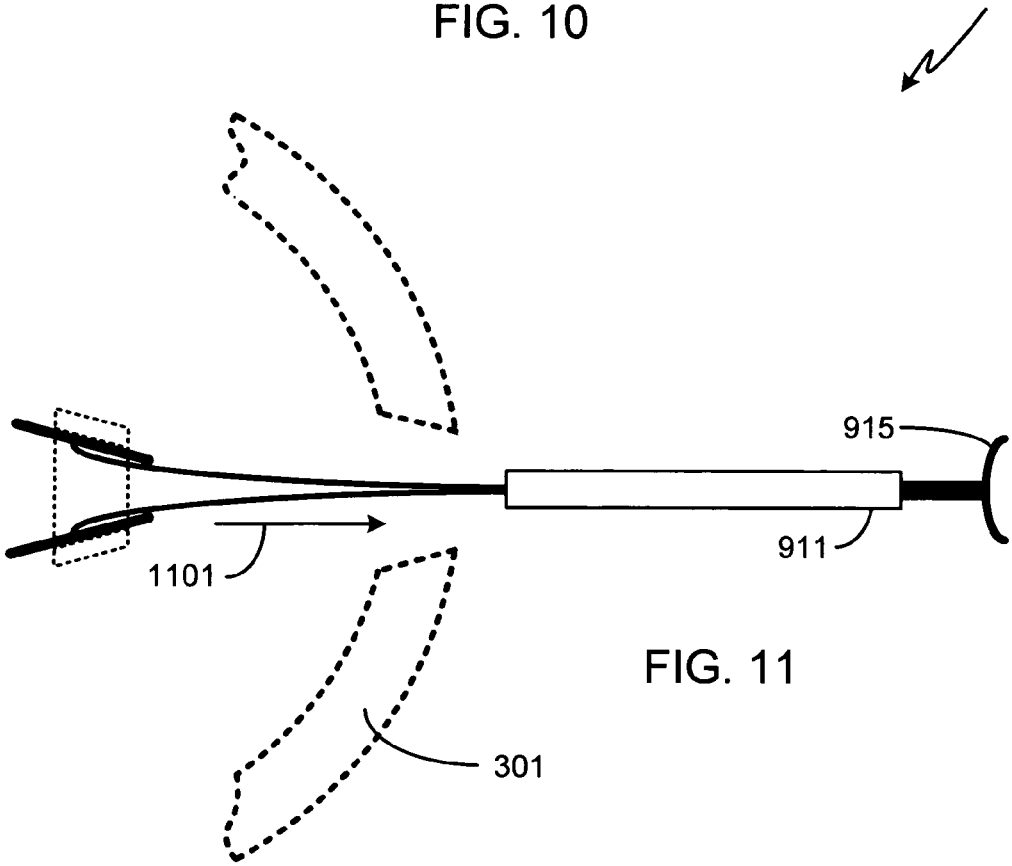
FIG. 11 is an illustration of the tool shown in FIG. 9 in which the ring holding members are expanded in order to capture the mounting ring.

FIGS. 9–11 illustrate a tool 901 that can be used to pull ring 703 into place. At the end of tool 901 are a plurality of members 903; preferably three members 903 are used. Preferably members 903 are fabricated from a spring steel or similar material, the members designed to exert a force 905 away from the tool's centerline 907. At the end of each member 903 is a grabbing surface 909. Surfaces 909 can be shaped so that when they are extended they have a cone angle similar to that of member 705. Alternately surfaces 909 can be coupled to members 903 by small flexible or hinge-like joints allowing surfaces 909 to adapt to a variety of different cone angles. Surfaces 909 can be comprised of a hard material (e.g., stainless steel) or a semi-hard material (e.g., plastic) and may or may not include a softer, external surface (not shown), for example comprised of an elastomeric material.

The distal end of members 903 are rigidly coupled together, for example at a location 911. A tube 913 slides over members 903. When tube 913 is positioned close to surfaces 909 and far from distal end portion 915, surfaces 909 are compressed together, thus allowing them to be pushed through ring 703. This step is illustrated in FIG. 10 in which ring 703 is shown in phantom. After ring 703 is properly positioned relative to surfaces 909, tube 913 is slid back close to distal end portion 915, causing members 903 to exert an outward force 905 on the internal surface of ring 703 (FIG. 11). Then tool 901 can be used to pull ring 703 in a direction 1101, thus moving ring 703 into port 701 (wall 301 also shown in phantom). Once the ring is in place, members 903 are again compressed through movement of tube 913, thus allowing the removal of tool 901.

As previously noted, there are countless ways to move member 705 into placed within ring 703 or to insert member 603 into port 601. Additionally it will be appreciated that the choice of the method depends in part on the exact nature of member 705 or member 603. For example if the member is a gas feed-thru, it may already include a tube that can be used to pull the member into location.

Figure 12:
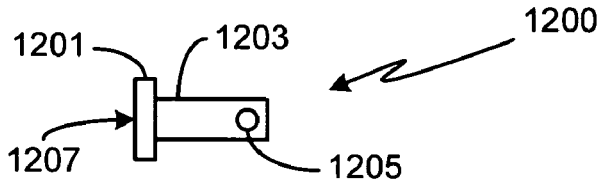
FIG. 12 is an illustration of a tool used to pull a window into place.

One method of pulling member 705 into ring 703 or inserting member 603 into port 601 is with a tool 1200 as illustrated in FIG. 12. The inventor has found that this tool is particularly useful when the member in question is a window. Tool 1200 is comprised of an end portion 1201 and a handle portion 1203. Within portion 1203 is a hole 1205. In the preferred embodiment, end portion 1201 is disc shaped and handle portion 1203 is bar-shaped. Although end portion 1201 and handle portion 1203 can be fabricated individually, preferably they are fabricated from a single piece of material. It will be appreciated that the dimensions of tool 1200 are determined in large part on the dimensions of the member in question (i.e., member 603 or member 705) as well as the internal diameter of chamber 101. For example, a larger member typically requires a larger portion 1201 to insure sufficient holding surface. Furthermore, the smaller the inside diameter of chamber 101, the smaller the overall dimensions of tool 1200 must be in order to allow it to be manipulated within the chamber.

In the preferred method of using tool 1200, initially the end surface 1207 of end portion 1201 is bonded to the outermost surface of the member in question using an adhesive that can be easily removed after the member is properly positioned within the desired chamber port. Preferably tool 1200 is bonded to the member prior to inserting the member into the chamber, thus minimizing the risk of any adhesive contaminating or bonding to the inside surface of the chamber.

Assuming that the member to be positioned is member 705, preferably member 705 and attached tool 1200 are first inserted into the chamber and then ring 703 is pulled into place. A small rod with a hooked end is inserted into port 701 and the hooked end is used to capture tool 1200 via hole 1205. The rod is then used to pull member 705 into place. Once member 705 is locked into place, for example with a retaining ring or plate as described below or with an adhesive, tool 1200 is detached from member 705. The end surface of member 705 is then cleaned to remove any remnants of the adhesive.

Assuming that the member to be positioned is member 603, preferably member 603 and attached tool 1200 are inserted into the chamber through port 701. If member 603 is not partially coated with an adhesive or sealant, typically a single rod can be used to position member 603 within port 601. Often, however, it is preferred to coat or partially coat the exterior cone-shaped surface of member 603 with an adhesive (e.g., epoxy) so that it remains within the port once positioned. Such adhesive is especially important if other means of holding member 603 in place (e.g., retaining ring or plate) are not practical, for example with a non-machinable window, since member 603 must be held in place to prevent it from falling within the chamber during degassing procedures, vacuum operation of the chamber, etc. In these circumstances two positioning rods are preferably used in order to prevent any adhesive from accidentally being deposited on an internal chamber surface. The hooked end of a first rod captures member 603 via hole 1205 and passes the member into the chamber through port 701. A second rod, also with a hooked end, is then inserted through port 601. The second rod is then hooked into hole 1205 and the first rod is released from hole 1205 and removed from the chamber. The second rod then pulls member 603 into place. After member 603 is locked into place, tool 1200 is detached from member 603 and the end surface of member 603 is cleaned to remove any remnants of adhesive. After all ports 600 have been assembled, port assembly 700 can be assembled.

Figure 13:
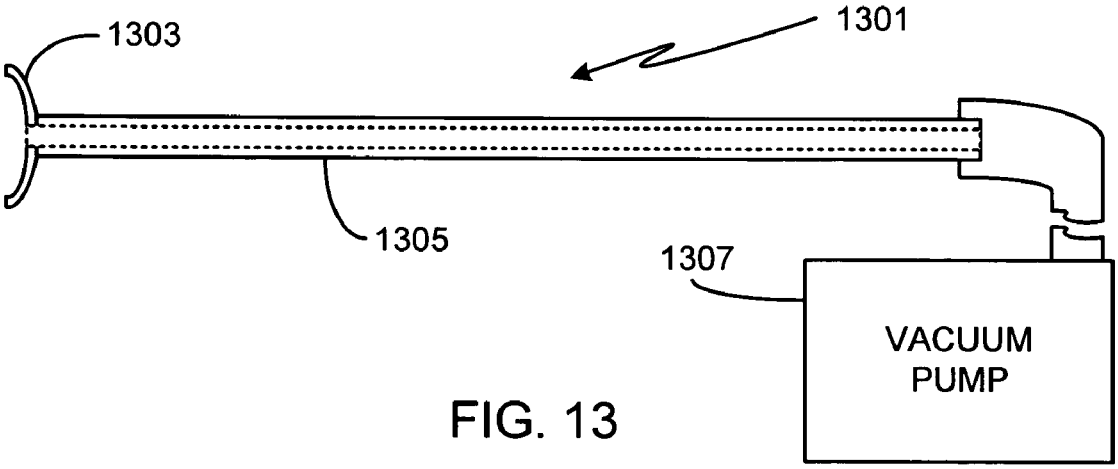
FIG. 13 is a cross-sectional view of an alternate tool used to pull a window into place.

An alternate technique of moving a member into the desired port is through the use of a tool 1301, shown in cross-section in FIG. 13. At one end of tool 1301 is a cup-shaped, pliable member 1303. Handle 1305 of tool 1301 is hollow. By coupling handle 1305 to a suitable low vacuum source 1307, member 1303 can be used as a suction cup. During use, cup-shaped member 1303 is placed against the small diameter end of member 603 or 705, vacuum is applied, the member (i.e., 603 or 705) is moved into place, and the vacuum is discontinued allowing removal of tool 1301. Typically when tool 1301 is used with a member 603, tube 1305 is flexible, thus allowing it to be inserted first through port 601 and then through port 701. Member 603 is then attached to cup 1303, vacuum applied, and member 603 drawn through port 701 into place within port 601.

Figure 14:
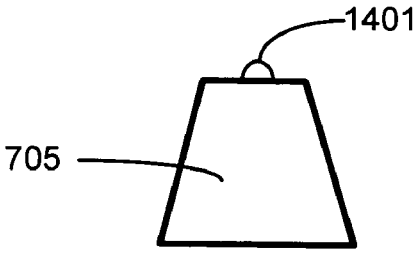
FIG. 14 is an illustration of a window with a temporary loop attached.

In an alternate technique of moving a member into place, a small loop 1401 is attached to the small diameter end of the desired member with a removable adhesive (FIG. 14). After the adhesive has cured, the member (either member 603 or member 705) is positioned within the desired port following similar procedures to those described above relative to tool 1200.

Figure 15:
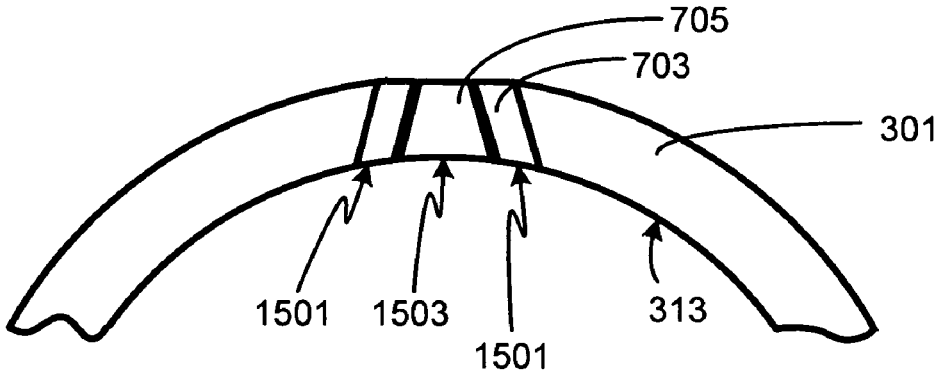
FIG. 15 is a cross-sectional view of a port assembly in which the inner surfaces of the mounting ring and member are curved to correspond to the curvature of the internal surface of the cavitation chamber.

In the assembly shown in FIG. 8, the surfaces of mounting ring 703 and member 705 that, upon assembly, become part of the inner surface of the cavitation chamber are shown as flat. In a preferred embodiment, however, these surfaces are curved to match the spherical curvature of the internal surface of cavitation chamber 101 as illustrated in FIG. 15. As shown, both surface 1501 of mounting ring 703 and surface 1503 of member 705 are shaped to match the spherical curvature of surface 313 of chamber 101. It will be understood, however, that if desired only one of these surfaces may be curved while the other is flat (not shown).

Figure 16:
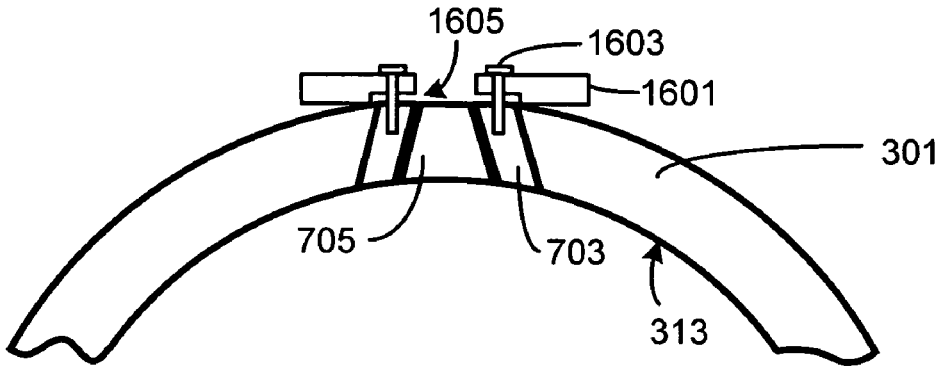
FIG. 16 is a cross-sectional view of a port assembly with an external retaining ring.
Figure 17:
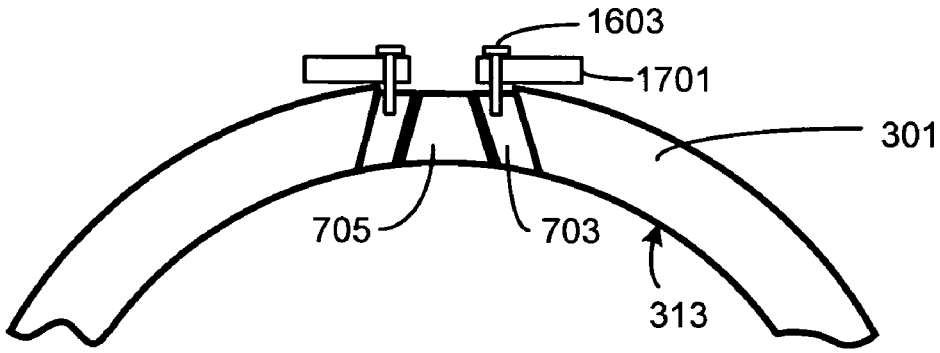
FIG. 17 is a cross-sectional view of a port assembly with an alternate external retaining ring.
Figure 18:
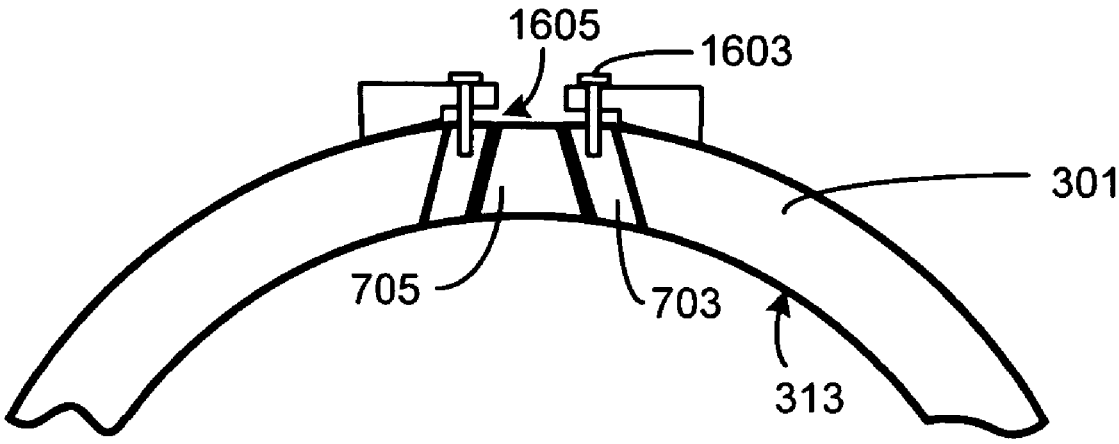
FIG. 18 is a cross-sectional view of a port assembly with an alternate external retaining ring.
Figure 19:
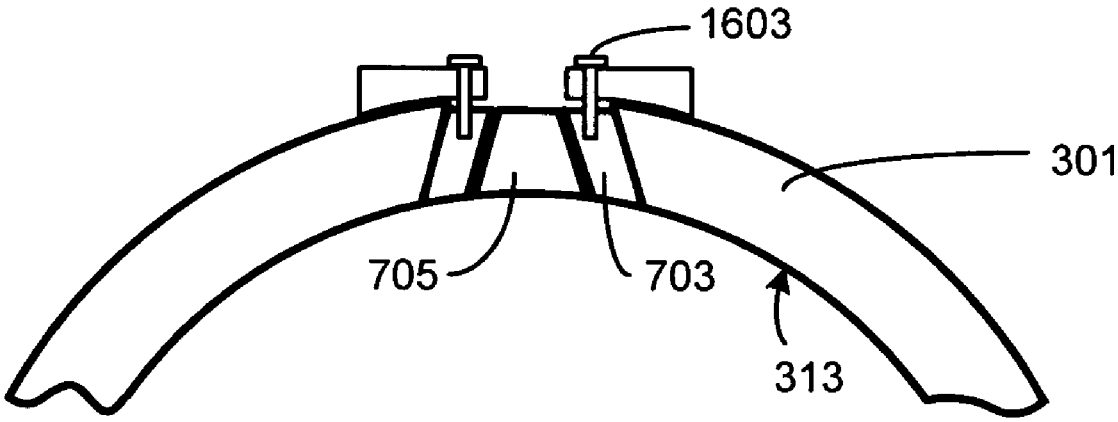
FIG. 19 is a cross-sectional view of a port assembly with an alternate external retaining ring.

Although the internal pressure of chamber 101 pushes both ring 703 and member 705 outward, in one preferred embodiment of the invention mounting ring 703 is coupled to chamber 101 with an external retaining ring 1601 and a plurality of bolts 1603 (FIG. 16). External retaining ring 1601 can be fabricated with a slight relief 1605, thus insuring that ring 703 is pulled tight within port 701. Alternately and as shown in FIG. 17, mounting ring 703 can be fabricated such that it has a length slightly less than the thickness of wall 301, thus insuring that a flat external retaining ring 1701 is able to pull ring 703 tight within port 701. Regardless of which external retaining ring design is used, the surface that is in direct contact with the outer surface of chamber 101 can either be flat as shown in FIGS. 16 and 17, or curved as shown in FIGS. 18 and 19.

Figure 20:
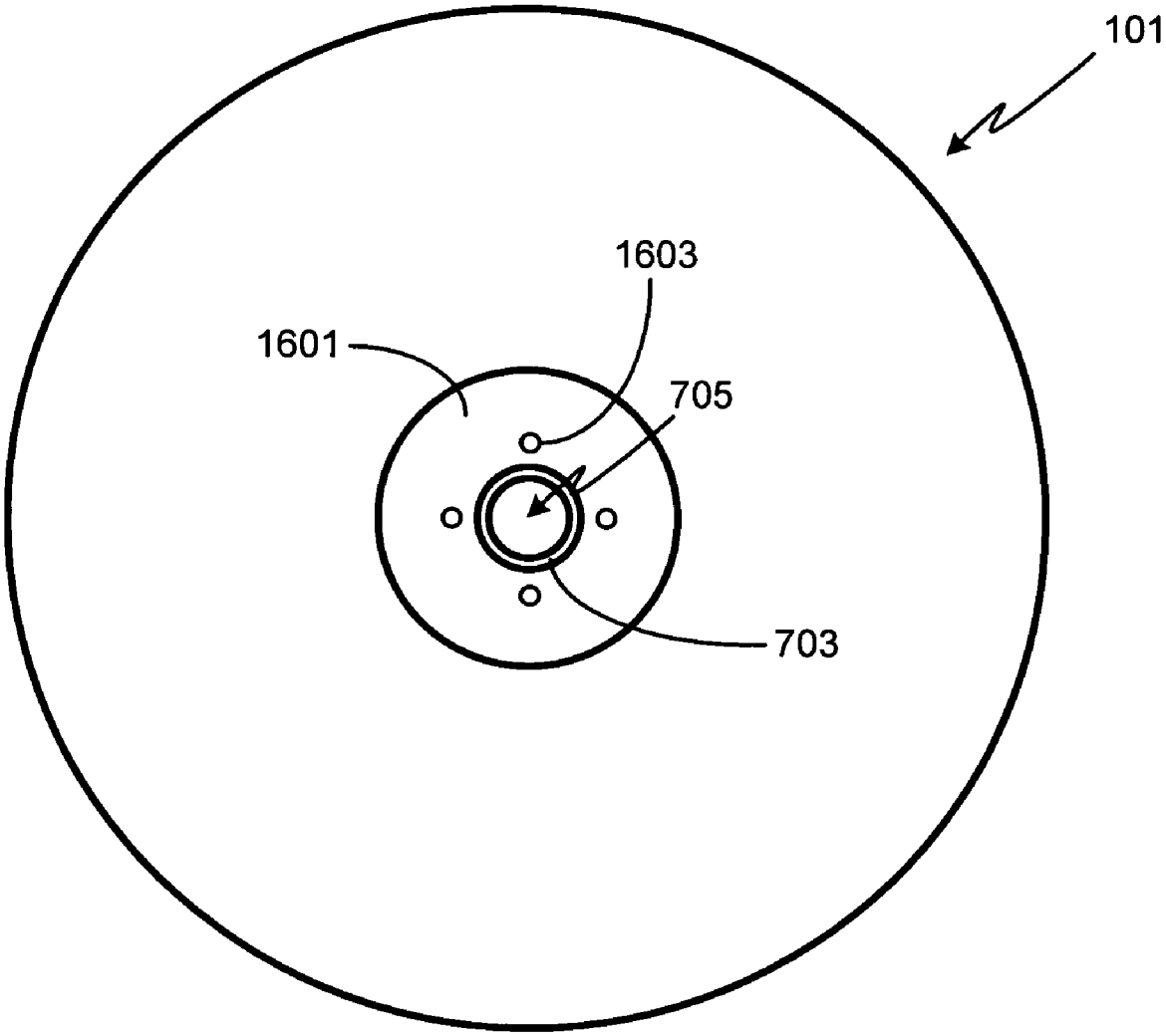
FIG. 20 is a frontal view of the port assembly shown in FIG. 16.

For clarity, FIG. 20 is a frontal view of one of the embodiments, specifically the assembly shown in FIG. 16. This view shows the external surface of cavitation chamber 101, member 705, the inside edge of mounting ring 703, external retaining ring 1601, and bolts 1603. This figure, as with the other figures contained herein, is only meant to illustrate the invention and should not be considered to be a scale drawing.

Figure 21:
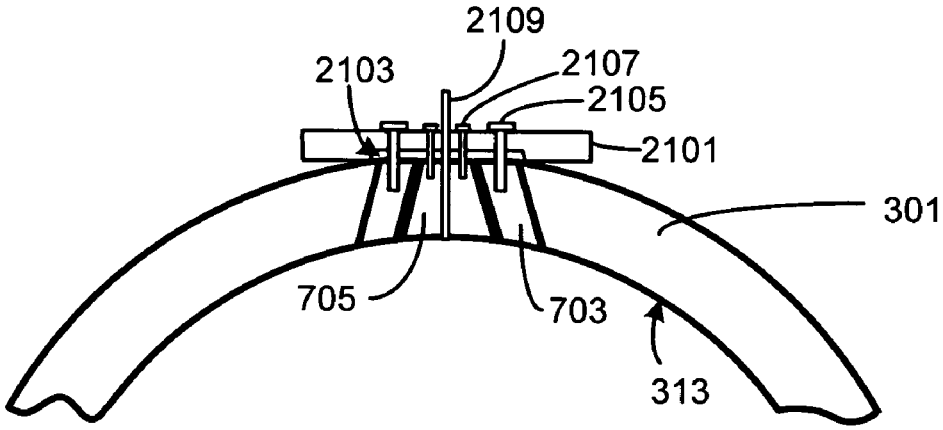
FIG. 21 is a cross-sectional view of a port assembly with an external retaining plate.
Figure 22:
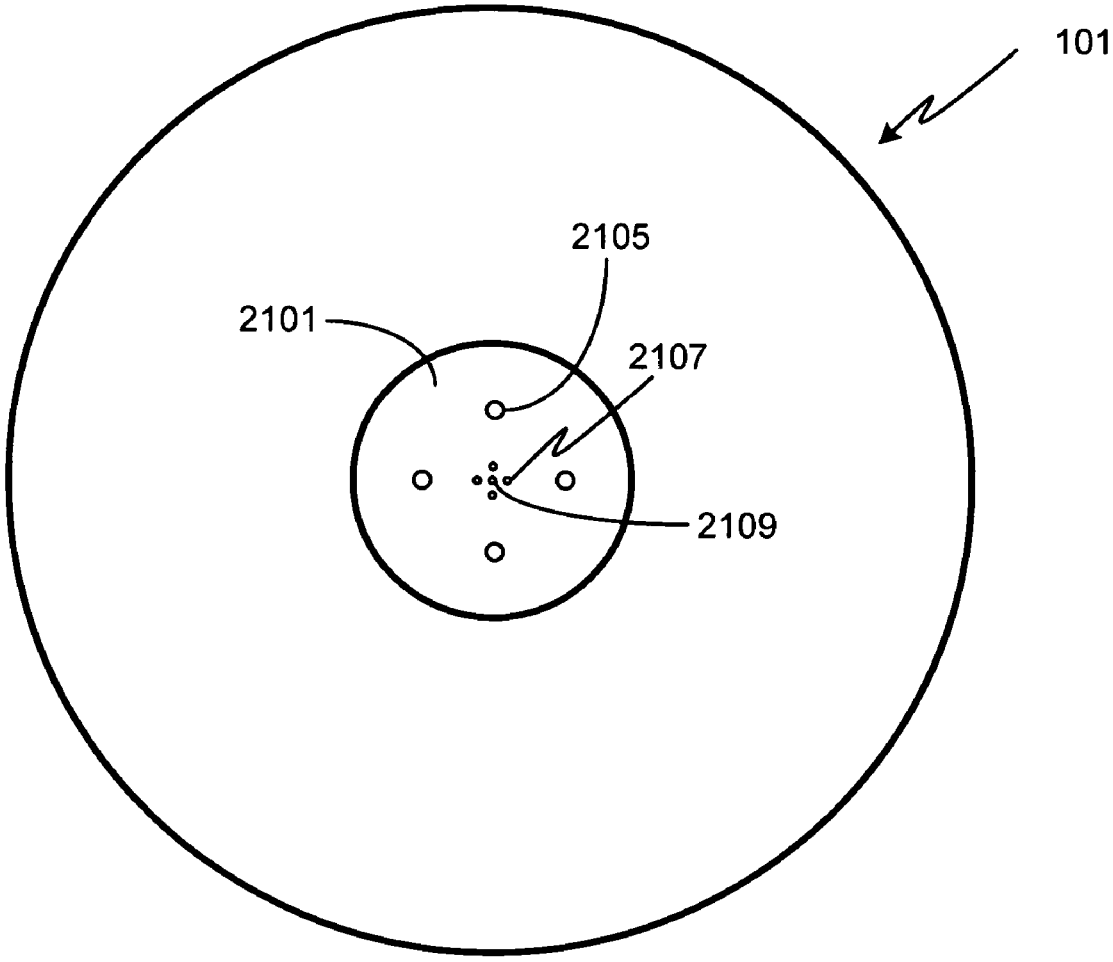
FIG. 22 is a frontal view of the port assembly shown in FIG. 21.

In the embodiments illustrated in FIGS. 16–20, it was assumed that it was desirable to leave the outermost surface of member 705 uncovered, as would be required if member 705 was a window. If member 705 is used for another purpose as previously described (e.g., gas or liquid feed-thru, sensor, plug, etc.) then the external retaining ring need not include an opening in the middle. FIGS. 21 and 22 illustrate an example of such an embodiment, this example utilizing the basic design features of the retaining ring shown in FIGS. 16 and 20. It will be appreciated that the retaining ring shown in any of FIGS. 17–19 could also be used as the basis for a solid retaining plate.

As shown, retaining plate 2101 has a relief 2103, thus allowing mounting ring 703 to be pulled tight within port 701 and member 705 to be pulled tight within mounting ring 703. More specifically, one or more bolts 2105 (four bolts 2105 are shown in the illustrated embodiment) pull mounting ring 703 tight within port 701 while one or more bolts 2107 (four bolts 2107 are shown in the illustrated embodiment) pull member 705 tight within ring 703. Although in the illustrated embodiment a feed-thru 2109 is shown, as previously noted retaining plate 2101 could also be used to mount a sensor, mechanical feed-thru, transducer coupler, plug, or other member.

Figure 23:
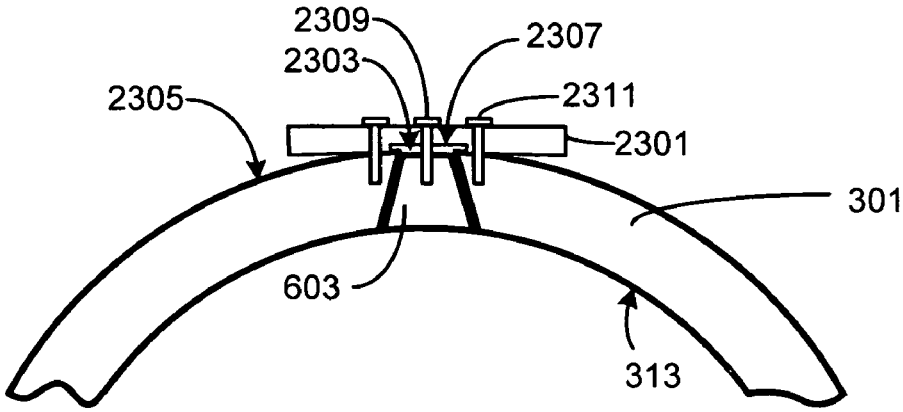
FIG. 23 is a cross-sectional view of a port assembly such as the assembly of FIG. 6 with an external retaining plate.

With respect to member 603, assuming that it is fabricated from a material that can be machined as opposed to most window material, a retaining plate similar to that shown in FIG. 21 can be used to hold member 603 within port 601. As shown in FIG. 23, retaining plate 2301 holds member 603 tightly within port 601. To insure a tight fit, preferably either the uppermost surface 2303 of member 603 is recessed relative to the outer surface 2305 of wall 301, the corresponding surface 2307 of plate 2301 is recessed relative to surface 2303, or both as shown in FIG. 23. One or more bolts 2309 pull member 603 tight within port 601. Although not preferred, if desired one or more bolts 2311 can attach retaining plate 2301 to chamber wall 301.

Although the embodiments shown above distribute the force on the port member (i.e., 603 or 705), thus minimizing deformation and/or breakage of the port member, in a preferred embodiment of the invention a thin sheet or foil of metal is interposed between the port member and either the mounting ring (for member 705) or the port (for member 603). For example, FIG. 8 shows a foil 704, for example of brass or other malleable metal, interposed between member 705 and mounting ring 703. It will be appreciated that although the inclusion of metal foil 704 is only indicated in FIG. 8, it can be used with any of the embodiments, not just the embodiment shown in FIG. 8. Additionally it should be understood that metal foil 704 is not required by the invention. It has been found that metal foil 704 is primarily useful when the port member (e.g., member 603 or member 705) is fabricated from a relatively fragile material (e.g., glass or sapphire window). Additionally it should be understood that a similar foil can be interposed between mounting ring 703 and port 701.

In one preferred embodiment of the invention, a sealant and/or adhesive is interposed between the adjacent surfaces of the port assemblies. For example, a sealant and/or adhesive can be interposed between mounting ring 703 and port 701, between member 705 and mounting ring 703, and/or between member 603 and port 601. The use of an adhesive between the port member (i.e., member 603, member 705) and the adjacent surface (i.e., port 601, ring 703) is especially useful when the member is a window or similar material that cannot be held in place with a bolt/retaining ring or bolt/retaining plate assembly as previously described. The use of an adhesive eliminates the need for a positive internal pressure to keep the member in place, thus allowing a vacuum to be pulled within the chamber which is useful during degassing and/or operational procedures.

Figure 24:
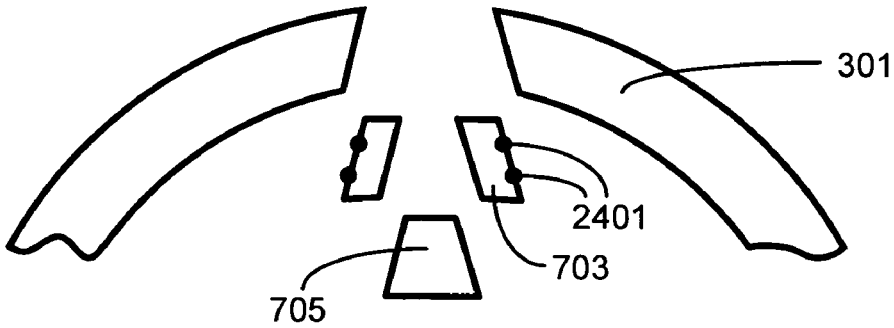
FIG. 24 is a cross-sectional view of a port assembly with o-rings used with the mounting ring.
Figure 25:
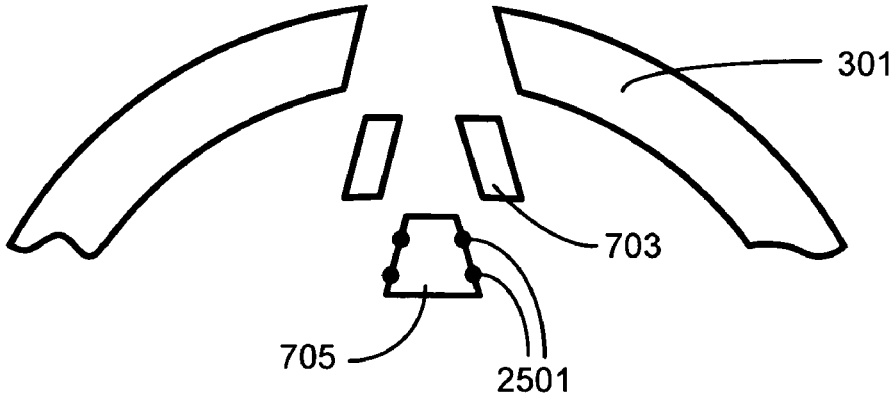
FIG. 25 is a cross-sectional view of a port assembly with o-rings used with the central member.

In one preferred embodiment of the invention, one or more o-rings are interposed between the adjacent surfaces of the port assemblies. For example, one or more o-rings can be interposed between mounting ring 703 and port 701, between member 705 and mounting ring 703, and/or between member 603 and port 601. FIG. 24 illustrates the use of multiple o-rings 2401 between the adjacent surfaces of mounting ring 703 and port 701. FIG. 25 illustrates the use of multiple o-rings 2501 between the adjacent surfaces of mounting ring 703 and port 701. It will be appreciated that o-rings can be used with any of the embodiments of the invention, for example with member 603 and port 601.

Figure 26:
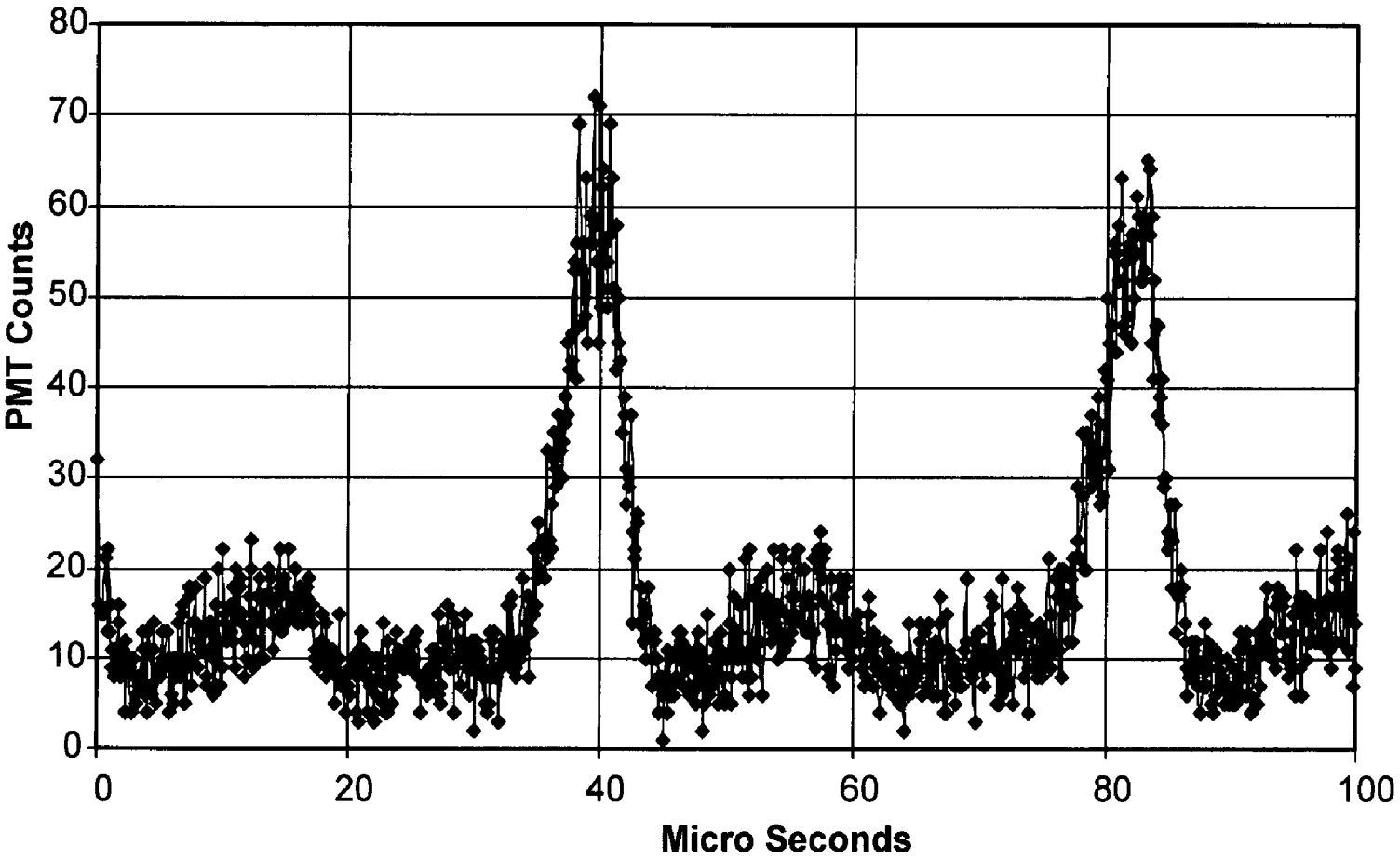
FIG. 26 is a graph of measured sonoluminescence data taken with a sphere fabricated in accordance with the invention.

FIG. 26 is a graph that illustrates the sonoluminescence effect with a cavitation sphere and port assembly (with window member) fabricated in accordance with the invention. The sphere was fabricated from stainless steel and had an outer diameter of 9.5 inches and an inner diameter of 8 inches. Six acoustic drivers (i.e., transducers) were mounted as illustrated in FIG. 1. For the data shown in FIG. 26, the liquid within the chamber was acetone. During operation, the temperature of the acetone was −27.5° C. The driving frequency was 23.52 kHz, the driving amplitude was 59 V RMS, and the driving power was 8.8 watts. Two acoustic cycles are shown in FIG. 26. It will be appreciated that the data shown in FIG. 26 is only provided for illustration, and that the invention is not limited to this specific configuration.

As will be understood by those familiar with the art, the present invention may be embodied in other specific forms without departing from the spirit or essential characteristics thereof. Accordingly, the disclosures and descriptions herein are intended to be illustrative, but not limiting, of the scope of the invention which is set forth in the following claims.

What is claimed is:

1. A method of assembling a port assembly in a cavitation chamber, the method comprising the steps of:

boring a cone-shaped port in a cavitation chamber wall of a first cavitation chamber piece of the cavitation chamber, wherein the cavitation chamber is comprised of multiple cavitation chamber pieces including said first cavitation chamber piece, wherein an external port diameter associated with a cavitation chamber external surface is smaller than an internal port diameter associated with a cavitation chamber internal surface;

locating a mounting ring with a cone-shaped external surface corresponding to said cone-shaped port within said multiple cavitation chamber pieces, said mounting ring having an internal cone-shaped surface defined by a first diameter associated with said cavitation chamber internal surface and a second diameter associated with said cavitation chamber external surface, wherein said second diameter is smaller than said first diameter;

joining said multiple cavitation chamber pieces together to form the cavitation chamber, wherein said mounting ring is located within said cavitation chamber prior to completion of said joining step;

placing a member with a cone-shaped external surface corresponding to said internal cone-shaped surface of said mounting ring within said cavitation chamber, said cone-shaped external surface of said member defined by a third diameter corresponding to said cavitation chamber internal surface and a fourth diameter corresponding to said cavitation chamber external surface, and wherein said third diameter is smaller than said external port diameter;

pulling said mounting ring into said cone-shaped port; and pulling said member into said mounting ring.

2. The method of claim 1, further comprising the step of selecting said member from the group consisting of a window, a gas feed-thru, a liquid feed-thru, a mechanical feed-thru, a sensor, a sensor coupler, a transducer coupler, or a plug.

3. The method of claim 1, further comprising the step of shaping a mounting ring internal chamber surface associated with said cavitation chamber internal surface to form a curved surface.

4. The method of claim 3, said shaping step further comprising the step of selecting a curvature for said mounting ring internal chamber surface that matches a cavitation chamber internal surface curvature.

5. The method of claim 1, further comprising the step of shaping a member internal chamber surface associated with said cavitation chamber internal surface to form a curved surface.

6. The method of claim 5, said shaping step further comprising the step of selecting a curvature for said member internal chamber surface that matches a cavitation chamber internal surface curvature.

7. The method of claim 1, further comprising the step of coupling a retaining ring to said mounting ring.

8. The method of claim 7, further comprising the step of recessing a mounting ring external chamber surface relative to said cavitation chamber external surface prior to said coupling step.

9. The method of claim 7, further comprising the step of recessing a portion of a retaining ring surface adjacent to a mounting ring external chamber surface, said recessing step performed prior to said coupling step.

10. The method of claim 7, further comprising the step of shaping a retaining ring surface adjacent to said cavitation chamber external surface.

11. The method of claim 1, further comprising the step of coupling a retaining plate to said member.

12. The method of claim 11, further comprising the steps of recessing a member external chamber surface relative to said cavitation chamber external surface and recessing a retaining ring external chamber surface relative to said cavitation chamber external surface prior to said coupling step.

13. The method of claim 11, further comprising the step of recessing a portion of a retaining plate surface adjacent to a member external chamber surface, said recessing step performed prior to said coupling step.

14. The method of claim 11, further comprising the step of coupling said retaining plate to said mounting ring.

15. The method of claim 11, further comprising the step of shaping a retaining plate surface adjacent to said cavitation chamber external surface.

16. The method of claim 1, further comprising the step of interposing a malleable material between said member and said mounting ring prior to said step of pulling said member into said mounting ring.

17. The method of claim 16, further comprising the step of selecting a metal for said malleable material.

18. The method of claim 16, further comprising the step of selecting brass as said malleable material.

19. The method of claim 1, further comprising the step of interposing a malleable material between said mounting ring and said cone-shaped port prior to said step of pulling said mounting ring into said cone-shaped port.

20. The method of claim 19, further comprising the step of selecting a metal for said malleable material.

21. The method of claim 19, further comprising the step of selecting brass as said malleable material.

22. The method of claim 1, further comprising the step of interposing at least one o-ring between said member and said mounting ring prior to said step of pulling said member into said mounting ring.

23. The method of claim 1, further comprising the step of interposing at least one o-ring between said mounting ring and said cone-shaped port prior to said step of pulling said mounting ring into said cone-shaped port.

24. The method of claim 1, further comprising the step of interposing a sealant between said member and said mounting ring prior to said step of pulling said member into said mounting ring.

25. The method of claim 1, further comprising the step of interposing a sealant between said mounting ring and said cone-shaped port prior to said step of pulling said mounting ring into said cone-shaped port.

26. The method of claim 1, further comprising the step of interposing an adhesive between said member and said mounting ring prior to said step of pulling said member into said mounting ring.

27. The method of claim 1, further comprising the step of interposing an adhesive between said mounting ring and said cone-shaped port prior to said step of pulling said mounting ring into said cone-shaped port.

28. The method of claim 1, wherein the joining step uses a brazing procedure.

* * * * *